US005144541A

United States Patent [19]

Schonbek

[11] Patent Number: 5,144,541

[45] Date of Patent: Sep. 1, 1992

[54] HOOKLESS GALLERY ASSEMBLIES FOR CHANDELIERS

[75] Inventor: Arnold Schonbek, Plattsburgh, N.Y.

[73] Assignee: A. Schonbek & Co., Inc., Plattsburgh, N.Y.

[21] Appl. No.: 772,281

[22] Filed: Oct. 7, 1991

Related U.S. Application Data

[63] Continuation-in-part of Ser. No. 725,347, Jul. 3, 1991, abandoned.

[51] Int. Cl.[5] ..... F21S 1/06

[52] U.S. Cl. ..... 362/405; 362/332; 362/457; 362/806

[58] Field of Search ..... 63/1.1; 248/322, 915; 362/147, 404, 405, 406, 408, 409, 457, 806, 332, 339; 428/28

[56] References Cited

U.S. PATENT DOCUMENTS 3,530,289 9/1970 Friedman et al. ..... 362/332
3,533,139 10/1970 Gomes et al. ..... 428/28 X
3,629,571 12/1971 Schonbek ..... 362/457

FOREIGN PATENT DOCUMENTS 923687 4/1963 United Kingdom ..... 362/332

*Primary Examiner*—Stephen F. Husar
*Attorney, Agent, or Firm*—Wolf, Greenfield & Sacks

[57] ABSTRACT

A gallery assembly for a decorative lighting chandelier includes a gallery ring and a plurality of decorative chains suspended from the gallery ring. The gallery ring is provided with openings, or pockets, which are dimensioned and shaped to support the uppermost crystal of the decorative chain in an upright position without the use of hooks or other connector elements. The opening includes an elongated crystal-receiving portion and a gap portion. The gap portion permits the decorative chain to be installed on the gallery ring by passing the connector through the gap and then lowering the decorative chain into the crystal-receiving portion of the opening until the crystal contacts the gallery ring. Upright support of the uppermost crysal is ensured by providing only four points of contact between the crystal and the gallery ring.

17 Claims, 5 Drawing Sheets

HOOKLESS GALLERY ASSEMBLIES FOR CHANDELIERS

CROSS REFERENCE TO RELATED APPLICATION

This application is a continuation in part of application Ser. No. 07/725,347 filed Jul. 3, 1991, now abandoned.

FIELD OF THE INVENTION

This invention relates to decorative lighting chandeliers and, more particularly, to gallery assemblies wherein decorative chains of glass trimmings are suspended from a gallery ring without the use of hooks or other connectors.

BACKGROUND OF THE INVENTION

Decorative lighting chandeliers typically include one or more gallery assemblies. A gallery assembly includes a gallery ring attached to the chandelier in a horizontal or vertical orientation and multiple decorative chains of glass trimmings, or crystals, suspended from the gallery ring. The elements of the chain, which can have a variety of sizes and shapes, are flexibly connected together with various types of connectors. The crystals in the chain are frequently square or octagonal in shape. Other types of decorative elements may be attached to the gallery ring between the chains.

A prior art gallery assembly is shown in FIGS. 1 and 2. A gallery ring 10 includes regularly spaced holes 12. A glass crystal 14 is glued to a plastic strip 16 having suspension tabs 18. The crystal 14 with the plastic strip 16 attached thereto is mounted to gallery ring 10 with suspension tabs 18 extending through holes 12. A second crystal 20 is attached to suspension tabs 18 by two wire hooks 22. A third crystal 24 can be suspended from crystal 20 by connectors 26. Additional crystals can be attached in a similar manner. Decorative glass rods 28 with ball ends can also be mounted to the gallery ring 10.

The configuration shown in FIGS. 1 and 2 has several disadvantages, including frequent breakage of the glue joint between the crystal 14 and the plastic strip 16, difficulty in assembling the hook connectors in the suspension tabs on the plastic strip, and a relatively large and aesthetically unattractive spacing between the uppermost crystal and the first crystal below the gallery ring.

A somewhat improved prior art gallery assembly is shown in FIG. 3. An uppermost crystal 30 is glued to a plastic strip 32 having a single suspension tab 34. The crystal 30 and the plastic strip 32 are mounted to a gallery ring 36. A single connector 38 attaches a crystal 40 to suspension tab 34. The configuration of FIG. 3 is easier to assemble but does not alleviate the other disadvantages described above. Other prior art gallery assemblies have used hooks, metal clips and other types of connectors to attach decorative chains to gallery rings.

It is a general object of the present invention to provide improved decorative lighting chandeliers.

It is another object of the present invention to provide improved gallery assemblies for decorative lighting chandeliers.

It is a further object of the present invention to provide gallery assemblies wherein decorative chains are suspended from a gallery ring without the use of hooks, clips or other connecting devices.

It is still another object of the present invention to provide gallery assemblies which are low in cost and easy to manufacture.

It is another object of the present invention to provide gallery assemblies which are attractive in appearance.

SUMMARY OF THE INVENTION

According to the present invention, these and other objects and advantages are achieved in a gallery assembly for a decorative lighting chandelier comprising a plurality of decorative chains, each including an uppermost crystal and at least one additional crystal flexibly connected to the uppermost crystal by a connector, a gallery ring for supporting the decorative chains and means for attaching the gallery ring to a decorative lighting chandelier. The gallery ring includes a plurality of spaced apart openings. Each opening includes a crystal-receiving portion that is sized and shaped to receive the uppermost crystal and to support the uppermost crystal in a predetermined position. Each opening further includes a gap portion that joins the crystal receiving portion to one side edge of the gallery ring. The gap portion is sized such that the decorative chains can be installed on the gallery ring by passing the connector through the gap portion of a selected opening and lowering the decorative chain into the crystal receiving portion of the opening until the uppermost crystal rests on the gallery ring and the decorative chain hangs from the gallery ring.

The gallery ring can be a circular ring, an arc portion of a circular ring, a square ring or any other desired shape. The uppermost crystal is typically square or octagonal in outline, but can have any desired shape. The crystal-receiving portion of the opening is sized and shaped such that the crystal contacts the edges of the opening at only a few, typically four, points which are located as close as is practical to its outside edges. This insures that the crystal is supported in an upright orientation without tipping, despite variations in the crystal size and shape.

The uppermost crystal has a hole for receiving the connector. When the uppermost crystal is installed in the gallery ring, the bottom periphery of the connector hole is preferably located at least slightly below the points of contact between the uppermost crystal and the gallery ring. The weight of the hanging portion of the decorative chain tends to maintain the uppermost crystal in an upright position without tipping.

In a preferred embodiment, the connector is relatively wide in a first dimension and is relatively narrow in a second dimension perpendicular to the first dimension so that the decorative chain must be turned sideways during installation in order for the connector to pass through the gap portion of the opening. The decorative chain is then rotated by 90° and is lowered into the opening in the gallery ring.

BRIEF DESCRIPTION OF THE DRAWINGS

For better understanding of the present invention, together with the other and further objects, advantages and capabilities thereof, reference is made to the accompanying drawings which are incorporated herein by reference and in which.

DETAILED DESCRIPTION OF THE INVENTION

Figure 1:
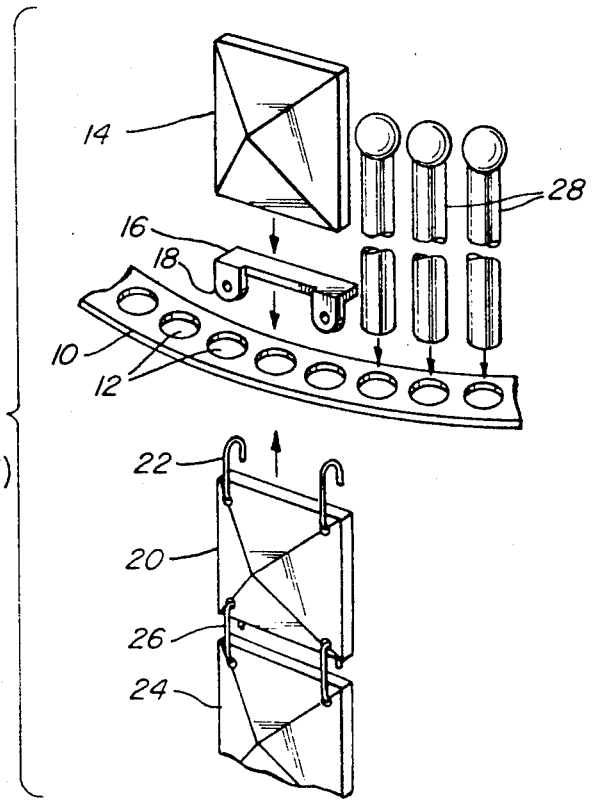
Fig. 1 (PRIOR ART)
FIG. 1 is an exploded perspective view of a gallery assembly in accordance with a first embodiment of the prior art.
Figure 2:
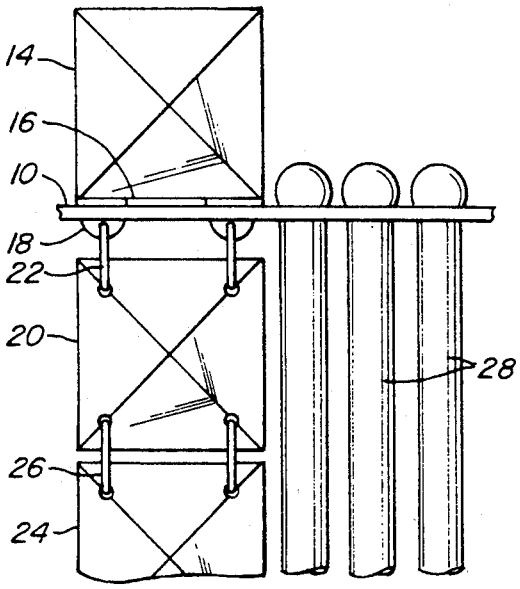
Fig. 2 (PRIOR ART)
FIG. 2 is a partial elevational view of the gallery assembly of FIG. 1.
Figure 3:
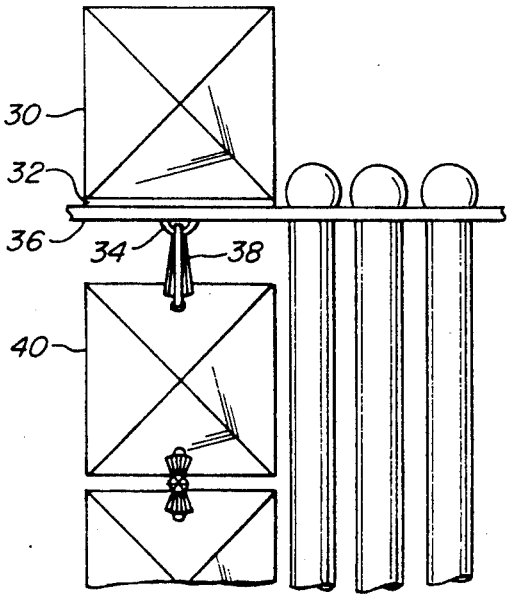
Fig. 3 (PRIOR ART)
FIG. 3 is a partial elevational view of a gallery assembly in accordance with a second embodiment of the prior art.
Figure 4:
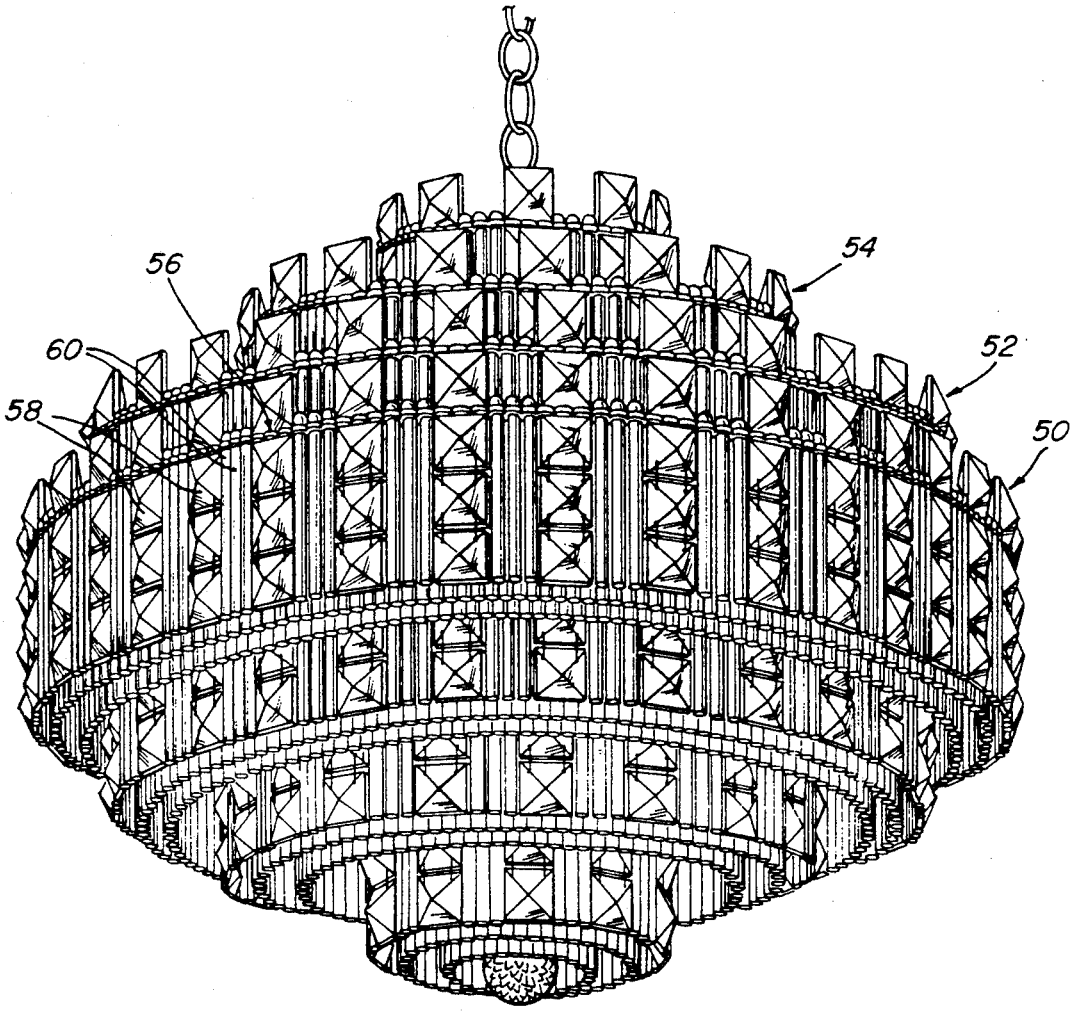
FIG. 4 illustrates a decorative lighting chandelier including multiple gallery assemblies.

An example of a decorative lighting chandelier is shown in FIG. 4. The chandelier includes multiple gallery assemblies 50, 52, 54, etc. Each gallery assembly includes a gallery ring 56 that supports a plurality of decorative chains 58. The decorative chains 58 each include crystals flexibly connected in a hanging chain. The crystals may have a variety of sizes, shapes and materials. Typically, the crystals are glass. Additional elements such as glass rods 60 can be suspended from the gallery ring 56. Except for the novel gallery assemblies of the present invention, the chandelier is conventional and includes conventional light bulbs, sockets, wiring, etc. (not visible in FIG. 4).

In the chandelier shown in FIG. 4, the gallery ring of each gallery assembly 50, 52, 54, etc. is circular. In other chandeliers, the gallery ring may be square, hexagonal or octagonal, or may be an arc portion of a circle. In general, the gallery ring can have any desired shape. As used herein, the phrase "gallery ring" refers to an element for support of decorative chains and is not limited to any particular shape. The gallery ring of each gallery assembly is typically attached to the chandelier by spokes that can be welded to the gallery ring. The spokes are attached to a central pipe of the chandelier.

Figure 5:
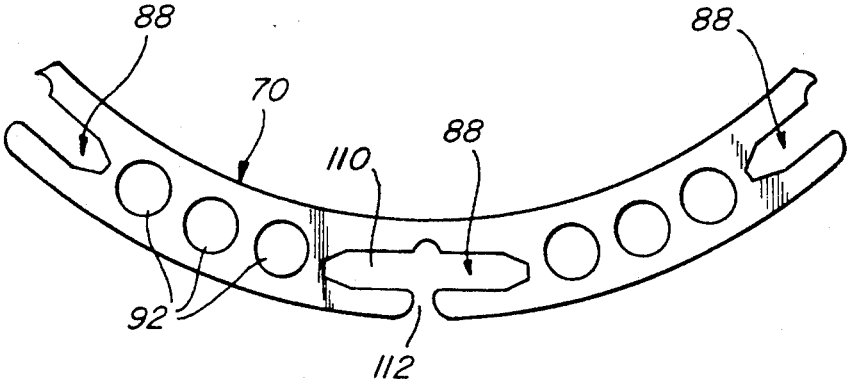
FIG. 5 is a partial top view of a gallery ring in accordance with the present invention for mounting square crystals.
Figure 6:
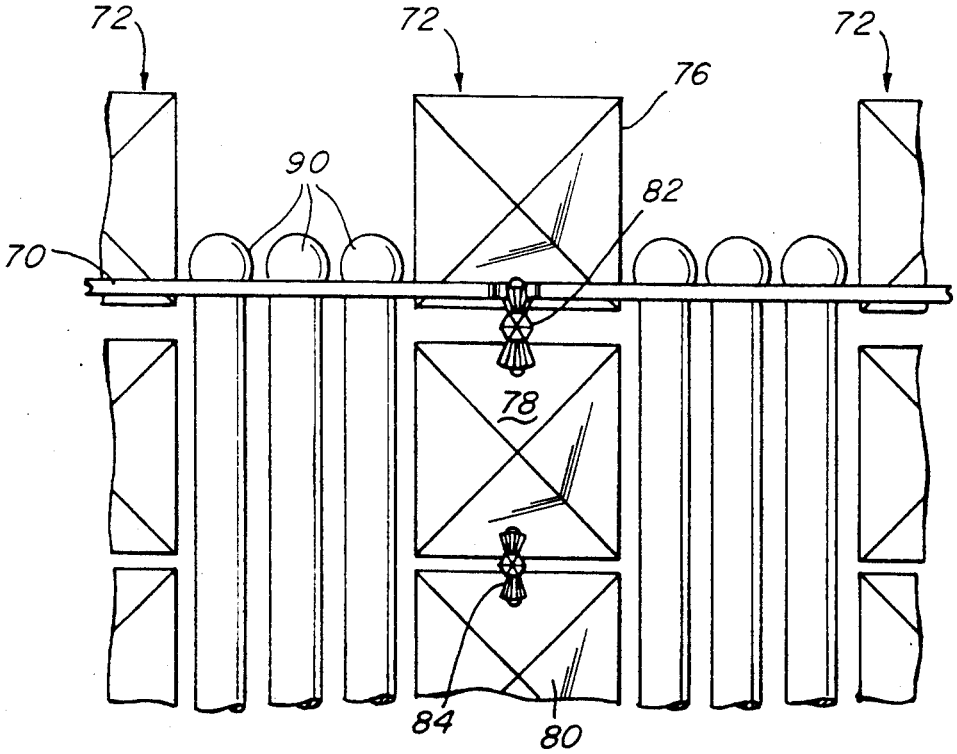
FIG. 6 is a partial elevational view of the gallery assembly in accordance with a first embodiment of the present invention.

A portion of a gallery ring 70 in accordance with the present invention is shown in FIG. 5 in a plan view, and a portion of a first embodiment of a gallery assembly utilizing the gallery ring 70 is shown in FIG. 6 in an elevation view. The gallery assembly includes the gallery ring 70 and a plurality of decorative hanging chains 72 suspended from gallery ring 70. Typically, the gallery ring 70 is a flat strip having a width in the range of about ½ inch to ¾ inch and a thickness in the range of about 1/16 inch to ⅛ inch. The gallery ring can be fabricated from steel, plastic or any other suitable material and is typically gold colored or silver colored. In a preferred embodiment, the inside and outside diameters of the gallery ring are laser cut from steel plate, and openings 88 and 92 are punched on a press. Each of the decorative chains 72 includes an uppermost crystal 76 and one or more additional crystals 78, 80, etc. The uppermost crystal 76 is flexibly connected to crystal 78 by connector 82, and crystal 78 is connected to crystal 80 by a connector 84. The uppermost crystal 76 of each decorative chain 72 rests in a pocket, or opening, 88 in gallery ring 70. As described in detail below, the opening 88 is sized and shaped to support uppermost crystal 76 in an upright orientation without requiring the use of hooks, plastic strips or any other connecting device. In the embodiment of FIGS. 5 and 6, ball end glass rods 90 are installed in holes 92 in the gallery ring 70 between each pair of decorative chains 72. It will be understood that a variety of different decorative elements can be attached to gallery ring 70 between the decorative chains 72. In some cases, only the decorative chains 72 may be used.

Figure 7A:
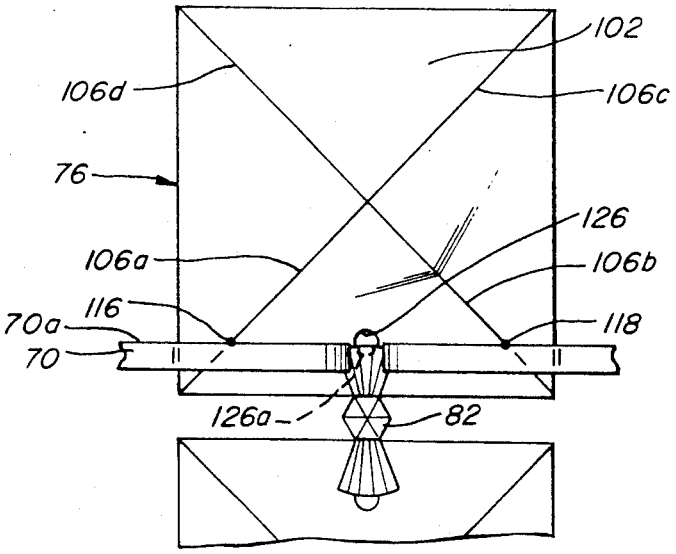
FIG. 7A is a front elevational view showing the details of the mounting of a square crystal in a gallery ring.
Figure 7B:
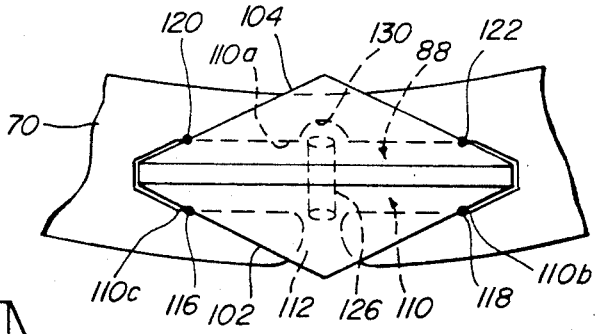
FIG. 7B is a top view showing details of the mounting of a square crystal in the gallery ring.
Figure 7C:
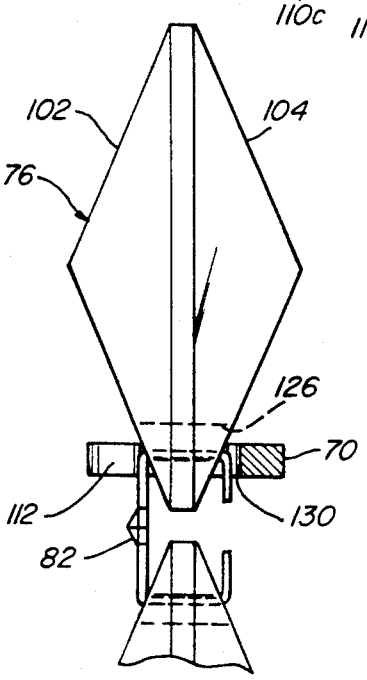
FIG. 7C is a cross sectional view of a gallery ring showing mounting details of a square crystal.

The mounting of uppermost crystal 76 in the opening 88 is shown in more detail in FIGS. 7A to 7C. The crystal 76 has a generally square outline as viewed in FIG. 6 and has a pyramidal front face 102 and a pyramidal rear face 104. The pyramidal faces 102 includes ridges 106*a*, 106*b*, 106*c* and 106*d*. Pyramidal face 104 has similar ridges. The opening 88 in the gallery ring 70 includes an elongated crystal receiving portion 110 and a gap portion 112 that joins the crystal receiving portion 110 to one side edge of gallery ring 70. The gap portion 112 is preferably on the outside edge of gallery ring 70 but can also be on the inside edge. The gap portion 112 permits installation of the decorative chain 72 on gallery ring 70 as described below.

The crystal receiving portion 110 of opening 88 is dimensioned and shaped so that crystal 76 is supported in an upright position, as shown in FIG. 6, without tipping either forwardly or backwardly or from side to side. The requirement for supporting the crystal 76 in an upright position without tipping provides the gallery assembly with the only desirable orientation of the chains, where the uppermost firmly located crystal 76 is oriented in line with one or more freely suspended crystals 78. The crystal must be supported in an upright position without tipping, despite variations in the size and shape of the crystal 76 due to manufacturing tolerances. In order to ensure upright support of the crystal 76, the crystal receiving portion of opening 88 is designed to support crystal 76 at only four points located as close as is practical to the outside edges of crystal 76. More specifically, crystal-receiving portion 110 is designed such that crystal 76 contacts the edges of opening 88 at point 116 on ridge 106*a*, at point 118 on ridge 106*b*, and at corresponding points 120 and 122 on the ridges of the rear face 104. In order to ensure contact only at points 116, 118, 120 and 122, the crystal receiving portion 110 of the opening 88 is slightly tapered from wider near central portion 110*a* to narrower near ends 110*b* and 110*c*. This ensures that the crystal 76 does not contact the sides of opening 88 in the central portion of crystal 76 and ensures the upright support described above. In order to obtain the desired accuracy, openings 88 in gallery ring 20 are preferably punched.

Crystal 76 is provided with a connector hole 126 for receiving the connector 82. Preferably, the crystal 76 rests in gallery ring 70 such that the bottom periphery 126*a* of connector hole 126 is at least slightly below the contact points 116, 118, 120 and 122 between crystal 76 and gallery ring 70. The contact points 116, 118, 120 and 122 are located on a top surface 70*a* of gallery ring 70. The location of connector hole 126 in this manner ensures that the weight of the hanging portion of decorative chain 72, which pulls downwardly on the bottom periphery 126*a* of connector hole 126, tends to maintain the crystal 76 in an upright orientation. The crystal receiving portion 110 of opening 88 can be provided with an indentation 130 to ensure clearance between the connector 82 and opening 88 when the decorative chain 72 is installed.

In order to install the decorative chain 72 in gallery ring 70, the decorative chain 72 is held at an appropriate level to pass connector 82 through gap portion 112 until crystal 76 is in vertical alignment with the crystal receiving portion 110 of opening 88. The decorative chain 72 is then lowered until crystal 76 contacts the gallery ring 70 at the sides of opening 88 at points 116, 118, 120 and 122. Installation of decorative chain 72 in gallery ring 70 is illustrated in FIG. 8.

The connector 82 is typically C-shaped and includes an upper portion which passes through connector hole 126, a lower portion which passes through a corresponding hole in crystal 78 and a middle portion connecting the upper and lower portions. Preferably the middle portion which faces outwardly has a decorative appearance. By locating the gap portion 112 on the outer periphery of gallery ring 70, the decorative chains 72 are relatively easy to install, and substantially the entire decorative portion of connector 82 is visible.

According to another feature of the invention, the gap portion 112 is dimensioned relative to connector 72 such that it is necessary to turn the decorative chain 72 sideways in order to pass connector 82 through gap portion 112. In this configuration, the outwardly facing part of the connector 82 is wider than gap portion 112, and the depth of connector 82 is less than the width of gap portion 112. After the connector 82 is passed through gap portion 112, the decorative chain 72 is rotated by 90° and the crystal 76 is lowered into contact with gallery ring 70. Thus, at least two distinct steps are required for installation of decorative chain 72 on gallery ring 70; including passing the connector 82 through gap portion 112 and then lowering crystal 76 into contact with gallery ring 70. When rotation of the decorative chain is required, a third step is added to the installation process. The installation process provides some resistance to pilfering of the decorative chains, which is often a problem in retail stores.

Figure 8:
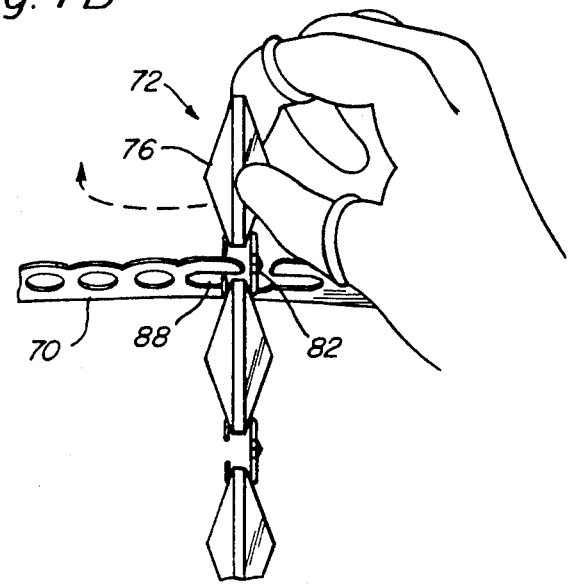
FIG. 8 is a pictorial view showing installation of a decorative chain in a gallery ring in accordance with the first embodiment of the present invention wherein the decorative chain is turned by 90° during installation.

Installation of decorative chain 72 in gallery ring 70 is illustrated in FIG. 8 for the case where turning of decorative chain 72 is required. Decorative chain 72 is oriented as shown so that connector 82 can be passed through the gap portion of opening 88. The decorative chain is then turned by 90°, and the crystal 76 is lowered into opening 88 until it contacts the gallery ring 70.

In general, the uppermost crystal in the decorative chain may have different shapes and sizes. The factors described above in the design of opening 88 can be applied to provide an opening for support of any size or shape crystal. These factors include designing the opening in the gallery ring such that the crystal is supported at only a few, typically four, contact points which are located as near as is practical to its outside edges. Typically, the width of the crystal receiving portion of the opening is slightly tapered from wider near its center to narrower near each end. In addition, the crystal is preferably supported such that the bottom periphery of the connector hole is at least slightly below the points of contact between the crystal and the gallery ring to ensure an upright orientation. The gap portion of the opening is dimensioned to pass the connector that attaches the uppermost crystal to the first crystal below it.

Figure 9:
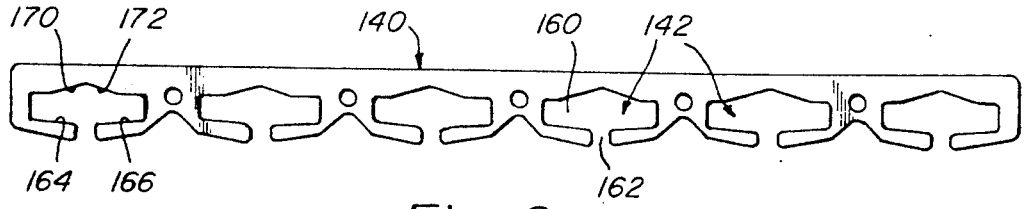
FIG. 9 is a partial top view of a gallery ring for mounting of octagonal crystals.
Figure 10:
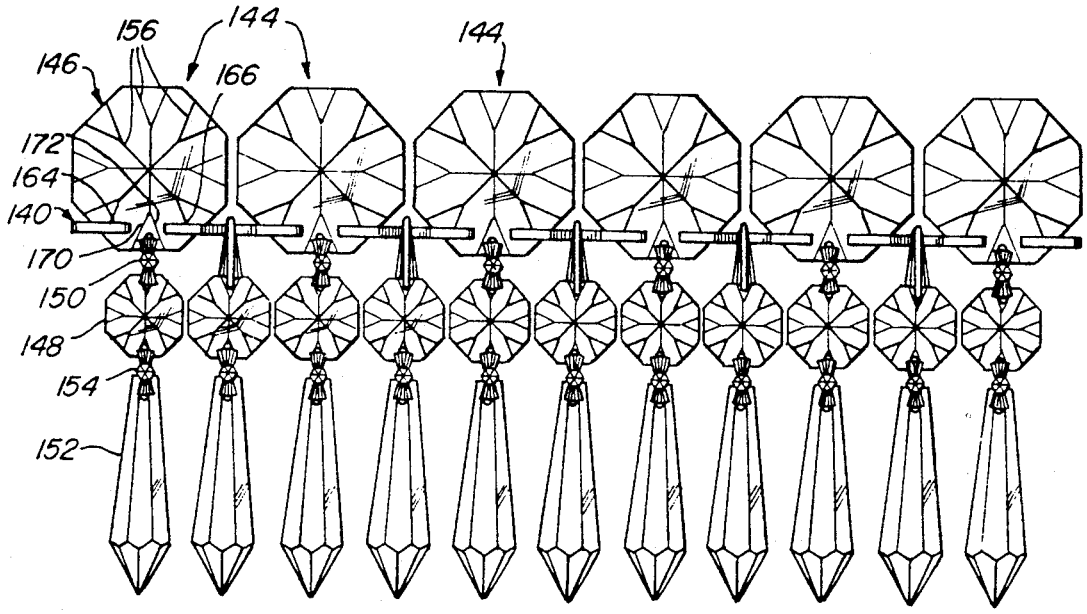
FIG. 10 is a partial elevation view of a gallery assembly in accordance with a second embodiment of the present invention.
Figure 11:
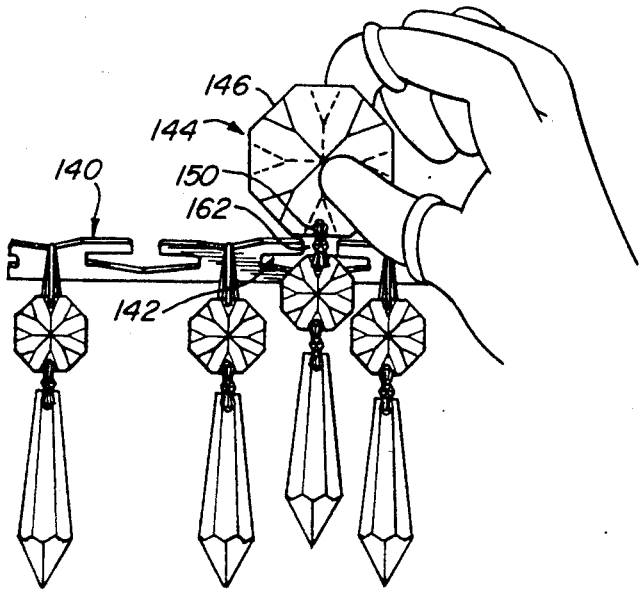
FIG. 11 is a pictorial view showing installation of a decorative chain in a gallery ring in accordance with the second embodiment of the present invention.

A gallery assembly utilizing crystals with an octagonal outline is shown in FIGS. 9–11. A portion of a gallery ring 140 is shown in FIG. 9, and a portion of a gallery assembly is shown in FIG. 10. The gallery ring 140 includes a plurality of openings 142 for supporting decorative chains 144. Each of the decorative chains 144 includes an uppermost crystal 146 having an octagonal outline, a crystal 148 suspended from crystal 146 by a connector 150 and a crystal 152 suspended from crystal 148 by a connector 154.

The front and rear faces of each uppermost crystal 146 have multiple ridges 156 which define the crystal shape. In the octagonal crystal shown in FIGS. 9–11, the pattern that defines the contour of the rear face is rotated by 45° with respect to the pattern that defines the front face. This is best illustrated in FIG. 11 wherein the solid lines on crystal 146 represent the contour of the front face and the dashed lines represent the contour of the rear face. As a result, the front and rear supports for the crystal must be different. It will be understood that a variety of different crystal shapes can be utilized within the scope of the present invention.

Each of the openings 142 in gallery ring 140 includes a crystal receiving portion 160 and a gap portion 162. The crystal-receiving portion 160 is dimensioned and shaped such that crystal 146 contacts gallery ring 140 at points 164 and 166 on the front face and at points 170 and 172 on the rear face. The points of contact are on ridges 156 of crystal 146 and are located as near as is practical to the outside edges of the crystal 146. As described above, the crystal-receiving portion 160 can be tapered in width from wider near the center to narrower at each end to ensure that the crystal 146 contacts the gallery ring 140 only at the desired four points. Because of the shape of the octagonal crystals as described above, the front and rear of the crystal receiving portion 160 have different shapes. Specifically, the front of crystal receiving portion 160 is tapered to contact crystal 146 at points 164 and 166, and the rear of crystal receiving portion 160 is tapered differently to contact crystal 146 at points 170 and 172. In the case of an octagonal crystal, the front and rear faces have tapered surfaces. The taper of the sides of crystal receiving portion 160 is made slightly greater than the taper of the crystal surface to ensure four point contact with gallery ring 140.

As in the case of the square crystal described above, the octagonal crystal 146 is located relative to gallery ring 140 such that the bottom periphery of the connector hole is at least slightly below the points of contact between the crystal and the gallery ring, thus ensuring that the crystal 146 is maintained in an upright position without tipping, despite variations in the size and shape of the crystal. The gap portion 162 is sufficiently wide to pass the connector 150 either with or without turning of the decorative chain as described above.

The installation of decorative chain 144 on gallery ring 140 is illustrated in FIG. 11. The decorative chain 144 is shown with connector 150 passing through gap portion 162. Subsequently, crystal 146 is lowered into opening 142 until it contacts the gallery ring 140.

The disclosed gallery assembly permits suspension of decorative chains in an attractive, upright orientation without the use of hooks or other connectors. The decorative chains are easy to install, and the manufacturing cost of the gallery assembly is relatively low.

While there have been shown and described what are present considered the preferred embodiments of the invention, it will be obvious to those skilled in the art that various changes and modifications may be made therein without departing from the scope of the invention as defined by the appended claims.

What is claimed is:

1. A gallery assembly for a decorative lighting chandelier, comprising:

a plurality of decorative chains each comprising an uppermost crystal and at least one additional crystal flexibly connected to said uppermost crystal by a connector; and a gallery ring for supporting said decorative chains, said gallery ring including a plurality of spaced-apart openings, each opening including a crystal-receiving portion that is sized and shaped to receive said uppermost crystal and to support said uppermost crystal in a predetermined position, each opening further including a gap portion that joins said crystal-receiving portion to one side edge of said gallery ring, said gap portion being sized such that said decorative chains can be installed on said gallery ring by passing said connector through the gap portion of a selected opening and lowering the decorative chain into the crystal-receiving portion of the opening until the uppermost crystal rests on said gallery ring, and the decorative chain hangs from said gallery ring.

2. A gallery assembly as defined in claim 1 wherein said gallery ring comprises a generally flat metal strip.

3. A gallery assembly as defined in claim 1 wherein said gallery ring comprises a circular ring that is horizontally mounted in said chandelier.

4. A gallery assembly as defined in claim 1 wherein the uppermost crystal in each of said decorative chains has a substantially square outline and pyramidal front and rear faces.

5. A gallery assembly as defined in claim 4 wherein the pyramidal front and rear faces of said uppermost crystal have ridges and wherein said opening is sized and shaped such that said ridges contact said gallery ring at four points.

6. A gallery assembly as defined in claim 1 wherein the uppermost crystal in each of said decorative chains has a substantially octagonal outline and front and rear faces having a plurality of ridges.

7. A gallery assembly as defined in claim 1 wherein the uppermost crystal in each of said decorative chains includes a connector hole for attachment of said connector and wherein a bottom periphery of said connector hole is located at least slightly below the points of contact between said uppermost crystal and said gallery ring when the decorative chain is installed in said gallery ring.

8. A gallery assembly as defined in claim 1 wherein said uppermost crystal contacts said gallery ring at only four points, 9. A gallery assembly as defined in claim 6 wherein the crystal-receiving portion of said opening includes an indentation for receiving said connector.

10. A gallery assembly as defined in claim 1 wherein the crystal receiving portion of said opening is tapered from wider near its center to narrower near each end to ensure that said uppermost crystal contacts said gallery ring at only four points.

11. A gallery assembly as defined in claim I wherein said connector is relatively wide in a first dimension and is relatively narrow in a second dimension perpendicular to said first dimension such that each of said decorative chains must be turned sideways during installation in order to pass said connector through the gap portion of said opening.

12. A gallery assembly for a decorative lighting chandelier comprising:

a plurality of decorative chains each comprising an uppermost element and at least one additional element flexibly connected to said uppermost element by a connector; and a gallery ring for supporting said decorative chains, said gallery ring including a plurality of spaced apart openings, each opening including a first portion that is sized and shaped to receive said uppermost element and to support said uppermost element in an upright position, each opening further including a second portion that joins said first portion to one side edge of said gallery ring, the first portion of said opening being tapered from wider near its center to narrower at each end to ensure that said uppermost element contacts said gallery ring at only four points.

13. A gallery assembly as defined in claim 12 wherein said gallery ring comprises a generally flat metal strip.

14. A gallery assembly as defined in claim 12 wherein said gallery ring comprises a circular ring that is horizontally mounted in said chandelier.

15. A gallery assembly as defined in claim 12 wherein the uppermost element in each of said decorative chains includes a connector hole for attachment of said connector and wherein a bottom periphery of said connector hole is located at least slightly below the points of contact between said uppermost element and said gallery ring when the decorative chain is installed in said gallery ring.

16. A gallery assembly as defined in claim 12 wherein said uppermost element contacts said gallery ring at only four points.

17. A gallery assembly as defined in claim 12 wherein the second portion of said opening is dimensioned to pass said connector during installation.

* * * * *